US005476743A

United States Patent [19]

Spiewak et al.

[11] Patent Number: 5,476,743

[45] Date of Patent: Dec. 19, 1995

[54] LIQUID DEVELOPER COMPOSITIONS WITH ORGANIC ADDITIVES

[75] Inventors: John W. Spiewak, Webster; James R. Larson, Fairport, both of N.Y.

[73] Assignee: Xerox Corporation, Stamford, Conn.

[21] Appl. No.: 357,471

[22] Filed: Dec. 16, 1994

[51] Int. Cl.[6] ..... G03G 9/135

[52] U.S. Cl. ..... 430/115

[58] Field of Search ..... 430/115

[56] References Cited

U.S. PATENT DOCUMENTS

| | | | |
|---|---|---|---|
| 4,702,984 | 10/1987 | El-Sayed et al. | 430/115 |
| 4,977,056 | 12/1990 | El-Sayed | 430/115 |
| 5,019,147 | 5/1991 | Voisine et al. | 65/360 |
| 5,026,621 | 6/1991 | Tsubuko et al. | 430/109 |
| 5,030,535 | 7/1991 | Drappel et al. | 430/116 |
| 5,266,435 | 11/1993 | Almog | 430/115 |
| 5,306,591 | 4/1994 | Larson et al. | 430/115 |
| 5,308,731 | 5/1994 | Larson et al. | 430/115 |

FOREIGN PATENT DOCUMENTS

| | | | |
|---|---|---|---|
| 28031 | 8/1976 | Japan | 430/115 |

*Primary Examiner*—Roland Martin
*Attorney, Agent, or Firm*—E. O. Palazzo

[57] ABSTRACT

A liquid developer comprised of a nonpolar liquid, thermoplastic resin particles, polar organic additives with a dielectric constant in the range of about 20 to about 150, and soluble in the nonpolar liquid; and charge director.

20 Claims, No Drawings

LIQUID DEVELOPER COMPOSITIONS WITH ORGANIC ADDITIVES

BACKGROUND OF THE INVENTION

This invention is generally directed to liquid developer compositions and, in particular, to liquid developers with polar organic additives with dielectric constants of 20 to 150 and preferably 30 to 100, including organic cyclic carbonates, amides, and cyclic sulfones and cyclic sulfoxides. The developers of the present invention can be selected for a number of known imaging and printing systems, such as xerographic processes, wherein latent images are rendered visible with the liquid developer illustrated herein. The image quality, solid area coverage and resolution for developed images usually require sufficient toner particle electrophoretic mobility. The mobility for effective image development is primarily dependent on the imaging system used. The electrophoretic mobility is primarily directly proportional to the charge on the toner particles and inversely proportional to the viscosity of the liquid developer fluid. A 10 to 30 percent change in fluid viscosity caused, for instance, by a 5° to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor solid area coverage if insufficient toner is transferred to the final substrate and can also lead to image defects such as smears and hollowed fine features. To overcome or minimize such problems, the liquid toners of the present invention were arrived at after extensive research efforts, and which toners result in, for example, sufficient particle charge for transfer and maintain the mobility within the desired range of the particular imaging system employed. Advantages associated with the present invention include increase of the liquid toner particle charge and an increase in the liquid toner particle charging rate. The toner charging rate refers to the increase in toner particle charge with time after charge director is added.

A slow charging rate can result in poor print quality, particularly background printing may result if the charging rate is too slow. When prints or developed copies are generated shortly after increasing the developer charge director concentration, for example, within 10 minutes thereof insufficiently rapid toner charging would result in a large concentration of neutral toner which develops out as background in the print. The additives of this invention improve the charging rate to such an extent that background printing would not occur when prints are generated 1 minute after increasing the developer charge director concentration.

A latent electrostatic image can be developed with toner particles dispersed in an insulating nonpolar liquid. The aforementioned dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

Useful liquid developers can comprise a thermoplastic resin and a dispersant nonpolar liquid. Generally, a suitable colorant, such as a dye or pigment, is also present. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 microns in diameter as measured with the Horiba Capa 700 Particle Size Analyzer.

Since the formation of proper images depends, for example, on the difference of the charge between the toner particles in the liquid developer and the latent electrostatic image to be developed, it has been

SUMMARY OF THE INVENTION

It is an object of the present invention to provide liquid developers with many of the advantages illustrated herein.

Another object of the present invention is to provide liquid developers capable of high particle charging and fast toner charging rates.

Another object of the invention to provide a negatively charged liquid developer wherein there is selected as charge directors ammonium AB diblock copolymers and polar organic additives with dielectric constants equal to or greater than about 20 including organic cyclic carbonates, organic amides, sulfoxides and sulfones.

It is still a further object of the invention to provide a liquid developer wherein developed image defects, such as smearing, loss of resolution and loss of density, are eliminated, or minimized.

Also, in another object of the present invention there are provided liquid developers with certain polar organic additives which result in higher particle charge and a higher charging rate, for example a liquid toner that contained a small amount dimethylformamide charged twice as fast and to more than 2 times the level than the same liquid toner without the dimethylformamide additive. Specifically, a 1 percent solids (solids include toner resin, pigment, and charge adjuvent like aluminum stearate) toner dispersed in NORPAR 15® and charged with a low amount of an ammonium AB diblock copolymer charge director (25 milligrams of charge director to every gram of toner solids) had a measured particle mobility of −0.1 E−10 $m^2/Vs$ which increased to −0.8 E−10 $m^2/Vs$ and −0.9 E−10 $m^2/Vs$ in 3 and 15 minutes, respectively, after the charge director level was increased to 60 milligrams/gram toner solids. The same liquid toner which contained 0.3 percent dimethylformamide additive of this invention charged to −1.6 E−10 $m^2/Vs$ and −2.5 E−10 $m^2/Vs$ in 3 and 15 minutes, respectively, after the charge director level was increased from 25 milligrams/gram toner solids to 60 milligrams/gram toner solids. The superior charging rate can improve the reliability of the liquid toner and enables excellent copy quality. The found desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 5,019,47, the disclosure of which is hereby totally incorporated herein by reference, discloses a liquid electrostatic developer comprising a nonpolar liquid, thermoplastic resin particles, and a charge director. The ionic or zwitterionic charge directors may include both negative charge directors such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) vinyl toluene and styrene and (iv) of butadiene and acrylate. As the copolymer of polyethylene and methacrylic acid or methacrylic acid alkyl esters, NUCREL® may be selected.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. No. 5,026,621 discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of the block copolymer is oriented to the surface of the block polymer and the compatible segment thereof is oriented to be compatible with other resins and a coloring agent contained in the toner, so that the toner is provided with both liquid repelling and solvent soluble properties.

Moreover, in U.S. Pat. No. 4,707,429 there are illustrated, for example, liquid developers with an aluminum stearate charge additive. Liquid developers with charge directors are also illustrated in U.S. Pat. No. 5,045,425. Further, stain elimination in consecutive colored liquid toners is illustrated in U.S. Pat. No. 5,069,995. Additionally, of interest are U.S. Pat. Nos. 4,760,009; 5,034,299 and 5,288,508.

The disclosures of each of the U.S. patents mentioned herein are totally incorporated herein by reference.

In copending patent application U.S. Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

In U.S. Pat. No. 5,306,591 and U.S. Pat. No. 5,308,731, the disclosures of which are totally incorporated herein by reference, there is illustrated a liquid developer comprised of a nonpolar liquid, thermoplastic resin particles, a nonpolar liquid soluble ionic or zwitterionic charge director, and a charge adjuvant comprised of an aluminum hydroxycarboxylic acid, or mixtures thereof. superior charge can result in improved image development and excellent image transfer.

Also, in another object of the present invention there are provided liquid developers with certain polar organic additives which result in higher particle charge, increased charging rate and a decreased level of background printing, for example a liquid toner that contained a small amount of butylene carbonate decreased the level of background printing 2 to 3 times compared to the identical liquid toner without the butylene carbonate additive. Specifically, a 1 percent solids (solids include toner resin, pigment, and aluminum stearate) toner dispersed in NORPAR 15® and charged with a low amount of ammonium AB diblock copolymer charge director (20 milligrams of charge director to every gram of toner solids) printed a background level of 0.16 reflectance density units and 1 minute after the charge director level was increased to 60 milligrams/gram printed a background level of 0.1 reflectance density units resulted. The same liquid toner which contained 0.3 percent butylene carbonate additive of this invention printed a background level of 0.07 reflectance density units and 1 minute after the charge director level was increased to 60 milligrams/gram printed a background level of 0.03 reflectance density units.

Another object of the present invention resides in the provision of negatively charged liquid toners with quaternary ammonium block copolymers which include a polar organic additive with dielectric constants greater than 20, including organic cyclic carbonates, organic amides, and cyclic sulfones whereby the charging rate and the magnitude of the negative charge of NUCREL® based toners, especially cyan and magenta toners, is enhanced.

These and other objects of the present invention can be accomplished in embodiments by the provision of liquid developers with certain polar organic additives. In embodiments, the present invention is directed to liquid developers comprised of a toner resin, pigment, a charge director and a polar organic additive including organic cyano, organic nitro, organic carbonates, amides, sulfones and sulfoxides. Embodiments of the present invention relate to a liquid electrostatographic developer comprised of (A) a nonpolar liquid having a Kauri-butanol value of from about 5 to about 30, and present in a major amount of from about 50 percent to about 95 weight percent, (B) pigment and thermoplastic resin particles having an average volume particle diameter of from about 0.5 to about 30 microns and preferably about 1.0 to about 10 microns in average volume diameter, (C) a nonpolar liquid soluble charge director compound, (D) a polar organic additive with a dielectric constant equal to or greater than 20 including cyclic carbonates, amides, cyclic sulfonate and cyclic sulfones, and (E) optionally a charge adjuvant.

Examples of polar organic additive compounds include materials that are soluble in the nonpolar fluid to at least about 0.01 percent by weight and preferably more than 0.05 percent to 5 percent by weight based on the total developer weight of resin, pigment, charge adjuvant, liquid or carrier fluid and charge director, and have a dielectric constant of from about 20 to about 150 and preferably from about 30 to about 100. Specific examples of additives present in amounts of from about 0.01 to about 10 percent by weight in embodiments include organic amides such as N,N-dimethylformamide, N,N-diethylformamide, N,N-dimethylacetamide, N,N-diethylacetamide, N,N-dimethylpropionamide, N,N-dimethylacrylamide, N,N-dimethylmethacrylamide, N,N,N',N'-tetramethylsuccinamide, N,N,N',N'-tetramethyladipamide, N-t-butylformamide, N,N-di-t-butylformamide, N-t-butylacetamide, N,N-di-t-butylacetamide, N,N,N'-trimethyl-N'-t-butylsuccinimide, N,N'-di-t-butyladipamide, N,N,N',N'-tetramethylurea, hexamethylphosphoramide, N-methyl-2-pyrrolidone, N-ethyl-2-pyrrolidone, 1,5-dimethyl-2-pyrrolidone, N-methyl-2-azetidinone, N-methyl-2-piperidone, N-methylcaprolactam, N-formyl-pyrrolidine, N-formyl-piperidine, 4-formyl-morpholine, N,N-dimethylcarboxamido-2-tetrahydrofuran, piperazine-N,N'-dicarboxaldehyde, N,N-dimethylbenzamide, N,N-dimethylbenzamide, and N,N,N',N'-tetramethylisophthalamide; organic cyclic sulfones such as tetramethylene sulfone also known as sulfolane, 3-methylsulfolane, 2,4-dimethylsulfolane, butadiene sulfone, trimethylene sulfone, pentamethylene sulfone, hexamethylenesulfone, 2,3-dimethylthiirene-1,1-dioxide, and 2,3-diphenylthiirene-1,1-dioxide; organic cyclic sulfoxides such as trimethylene sulfoxide, tetramethylene sulfoxide, pentamethylene sulfoxide, and hexamethylene sulfoxide; and organic cyclic carbonates such as ethylene carbonate also known as 1,3-dioxalane-3-one, vinylene carbonate, propylene carbonate also known as 4-methyl-1,3-dioxolane-2-one, butylene carbonate also known as 4,5-dimethyl-1,3-dioxolane-2-one, trimethylene carbonate, and tetramethylene carbonate.

Effective nonpolar liquid soluble, from about 0.5 percent to 80 percent by weight relative to developer solids and preferably about 2 percent to 20 percent by weight relative to developer solids, charge directors include components such as (1) a protonated AB diblock copolymer of poly[2-dimethylammoniumethyl methacrylate bromide co-2-ethylhexyl methacrylate], poly[2-dimethylammoniumethyl methacrylate tosylate co-2-ethylhexyl methacrylate], poly[2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], or poly[2-dimethylammoniumethyl methacrylate tosylate co-N,N-dibutylacrylamide]; (2) a mixture, for example 50:50, of at least two protonated AB diblock copolymers; or (3) a mixture, for example 50:50, of at least one protonated AB diblock copolymer and one quaternized AB diblock copolymer.

Preferred diblock copolymers selected as charge directors for the present invention can be represented by the following formula

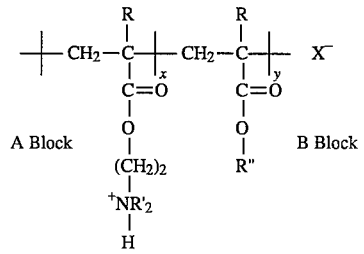

wherein the A block has a number average molecular weight of from about 200 to about 10,000 and the B block has a number average molecular weight of from about 2,000 to about 50,000 and wherein the number average degree of polymerization (DP) ratio of the B block to the A block is in the range of 10 to 2 to 100 to 20; $X^-$ is an anion of any strong acid, examples of which include fluoride, chloride, bromide, iodide, trifluoroacetate, trichloroacetate, bromoacetate, p-toluene sulfonate, methane sulfonate, dodecylbenzene sulfonate, trifluoromethane sulfonate, fluoroborate, hexafluorophosphate, sulfate, bisulfate, chlorosalicylate, tetrafluoroterephthalate, tetrafluorosuccinate, and the like; and R, R' and R" are as illustrated herein, such as alkyl, with R" being preferably alkyl with about 6 to about 12 carbon atoms.

Examples of specific diblock copolymer charge directors present in effective amounts of, for example, from about 0.5 to about 100 weight percent, and preferably from about 2 to about 20 percent relative to developer solids which include thermoplastic resin, polar organic additive pigment and charge adjuvant in embodiments include poly[2-dimethylammoniumethyl methacrylate bromide co-2-ethylhexyl methacrylate], poly[2-dimethylammoniumethyl methacrylate tosylate co-2-ethylhexyl methacrylate], poly[2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly [2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], and poly[2-dimethylammoniumethyl methacrylate tosylate co-N,N-dibutylacrylamide].

Other examples of suitable diblock copolymer charge directors include poly[4-vinyl-N,N-dimethylanilinium bromide co-2-ethylhexyl methacrylate], poly[4-vinyl-N,N-dimethylanilinium tosylate co-2-ethylhexyl methacrylate], poly [ethylenimmonium bromide co-2-ethylhexyl methacrylate], and poly[propylenimmonium bromide co-2-ethylhexyl methacrylate].

A preferred ammonium AB diblock copolymer charge director contains a polar A block in which the positive ammonium nitrogen is covalently bound to at least one hydrogen and a nonpolar B block which has sufficient aliphatic content to enable the block copolymer to more effectively dissolve in the nonpolar liquid having a Kauri-butanol value of less than 30. The A block has a number average molecular weight range of from about 200 to about 10,000 and the B block has a number average molecular weight range of from about 2,000 to 50,000. Number average degree of polymerization (DP) refers to the average number of monomeric units per polymer chain, and is related to the number average molecular weight ($M_n$) by the formula $M_n=M_0 \times DP$, where $M_0$ is the molecular weight of the monomer. Assuming an average $M_0$ of about 200 for both the A and B monomers, the above A block molecular weight ranges provide for a DP of about 1 to 50 and the above B block molecular weight ranges provide for a DP of about 10 to 250. Amine nitrogen protonation (ammonium ion formation) in the polar A block for satisfactory charge director performance should be at least 80 mole percent and preferably at least 90 mole percent. Other charge directors include di-t-butyl aluminum salicylate in resin particles without WITCO 22™ (aluminum stearate charge control agent) for positive charging liquid development systems.

The charge director can be selected for the liquid developers in various effective amounts, such as for example in embodiments from about 0.5 percent to 80 percent by weight relative to developer solids and preferably 2 percent to 20 percent by weight relative to developer solids. Developer solids includes toner resin, pigment, and charge adjuvant. Without pigment the developer may be selected for the generation of a resist, a printing plate, and the like. Examples of other effective charge director for liquid toner particles include anionic glyceride, such as EMPHOS® D70-30C and EMPHOS® F27-85, two products sold by Witco Corporation, New York, N.Y.; which are sodium salts of phosphated mono- and diglycerides with saturated and unsaturated substituents respectively, lecithin, Basic Barium Petronate, Neutral Barium Petronate, Basic Calcium Petronate, Neutral Calcium Petronate, oil soluble petroleum sulfonates, Witco Corporation, New York, N.Y., and metallic soap charge directors such as aluminum tristearate, aluminum distearate, barium, calcium, lead, and zinc stearates; cobalt, manganese, lead, and zinc lineolates, aluminum, calcium, and cobalt octoates; calcium and cobalt oleates; zinc palmitate; calcium, cobalt, manganese, lead, zinc resinates, and the like. Other effective charge directors include AB diblock copolymers of 2-ethylhexylmethacrylate-co-methacrylic acid calcium and ammonium salts.

Examples of liquid carriers selected for the developers of the present invention include a liquid with viscosity of from about 0.5 to about 500 centipoise, preferably from about 1 to about 20 centipoise, and a resistivity greater than or equal to about $5\times10^9$ ohm/centimeters, such as $10^{13}$ ohm/centimeters, or more. Preferably, the liquid selected in embodiments is a branched chain aliphatic hydrocarbon. A nonpolar liquid of the ISOPAR® series (manufactured by the Exxon Corporation) may also be selected for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C.; ISOPAR L® has a mid-boiling point of approximately 194° C.; ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of about $10^9$ ohm-centimeters and a dielectric constant below or equal to 3.0. Moreover, the vapor pressure at 25° C. should be less than or equal to 10 Torr in embodiments.

While the ISOPAR® series liquids are the preferred nonpolar liquids in embodiments for use as dispersants in the liquid developers of the present invention, the important characteristics of viscosity and resistivity can be achieved, it is believed, with other suitable liquids. Specifically, the NORPAR® series available from Exxon Corporation, the SOLTROL® series from the Phillips Petroleum Company, and the SHELLSOL® series from the Shell Oil Company can be selected.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably, 0.5 to 2.0 percent by weight.

Any suitable thermoplastic toner resin can be selected for the liquid developers of the present invention in effective amounts of, for example, in the range of about 99 percent to 40 percent of developer solids, and preferably 95 percent to 70 percent of developer solids, which developer solids includes the thermoplastic resin, optional pigment and charge control agent, and any other component that comprises the particles. Examples of such resins include ethylene vinyl acetate (EVA) copolymers (ELVAX®resins, E.I. DuPont de Nemours and Company, Wilmington, Del.); copolymers of ethylene and an a α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid and at least one alkyl ester of acrylic or methacrylic acid wherein alkyl is from 1 to about 20 carbon atoms like methyl methacrylate (50 to 90 percent)/methacrylic acid (0 to 20 percent/ethylhexyl acrylate (10 to 50 percent); and other acrylic resins including ELVACITE® acrylic resins (E.I. DuPont de Nemours and Company); or blends thereof. Preferred copolymers are the copolymer of ethylene and an α-β-ethylenically unsaturated acid of either acrylic acid or methacrylic acid. In a preferred embodiment, NUCREL®, like NUCREL 599®, NUCREL 699®, or NUCREL 960® are selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant selected may vary depending on the use of the developer. Examples of colorants include pigments like carbon blacks like REGAL 330®, cyan, magenta, yellow, blue, green, brown and mixtures thereof; pigments as illustrated in U.S. Pat. No. 5,223,368, the disclosure of which is totally incorporated herein by reference, and more specifically, the following

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, Cl 77266 |
| UHLICH ® BK 8200 | Paul Uhlich | Black |

To increase the toner particle charge and, accordingly, increase the mobility and transfer latitude of the toner particles, charge adjuvants can be added to the toner particles. For example, adjuvants, such as metallic soaps, like aluminum stearate, magnesium stearate or octoate, fine particle size oxides, such as oxides of silica, alumina, titania, and the like, paratoluene sulfonic acid, and polyphosphoric acid may be added. Negative charge adjuvants increase the negative charge of the toner particle, while the positive charge adjuvants increase the positive charge of the toner particles. With the invention of the present application, the adjuvants or charge additives, can be comprised of the metal catechol and aluminum hydroxy acid complexes illustrated in U.S. Pat. Nos. 5,306,590; 5,306,591 and 5,308,731, the disclosures of which are totally incorporated herein by reference, and these additives have the following advantages over the aforementioned prior art charge additives: improved toner charging characteristics, namely, an increase in particle charge, as measured by ESA mobility, of from −1.4 E−10 $m^2/Vs$ to −2.3 E−10 $m^2/Vs$, that results in improved image development and transfer, from 80 percent to 93 percent, to allow improved solid area coverage, and a transferred image reflectance density of 1.2 to 1.3. The adjuvants can be added to the toner particles in an amount of from about 0.1 percent to about 15 percent of the total developer solids and preferably from about 1 percent to about 5 percent of the total weight of solids contained in the developer.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound, reference U.S. Pat. No. 4,497,208, the disclosure of which is totally incorporated herein by reference. This technique is particularly useful for nonaqueous dispersions since the measurements can be made at high volume loadings, for example, greater than or equal to 1.5 to 10 weight percent. Measurements generated by this technique have been shown to correlate with image quality, for example high mobilities can lead to improved image density, resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in a nonpolar liquid, the thermoplastic resin, nonpolar liquid charging additive, polar organic additive and colorant in a manner that the resulting mixture contains, for example about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding the charge adjuvant compound to the dispersion; and diluting the dispersion.

In the initial mixture, the resin, colorant, polar organic additive and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient, nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant, organic additive and resin. However, the temperature at which this step is undertaken should not be so high as to degrade the nonpolar liquid or decompose the resin or colorant when present. Accordingly, the mixture can be heated to a temperature of from about 70° C. to about 130° C., and preferably to about 75° C. to about 110° C. The mixture may be ground in a heated ball mill or heated attritor at this temperature for about 15 minutes to 5 hours, and preferably about 60 to about 180 minutes. After grinding at the above temperatures, an additional amount of nonpolar liquid may be added to the dispersion. The amount of nonpolar liquid to be added at this point should be an amount sufficient to decrease the total solids concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like in a jacket surrounding the mixing vessel. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably 2 to 6 hours. Additional liquid may be added at any step during the preparation of the liquid developer to facilitate grinding or to dilute the developer to the appropriate percent solids needed for developing. Methods for the preparation of liquid developers are illustrated in U.S. Pat. Nos. 4,760,009; 5,017,451; 4,923,778 and 4,783,389, the disclosures of which are totally incorporated herein by reference.

Methods of imaging are also encompassed by the present invention wherein after formation of a latent image on a photoconductive imaging member, reference U.S. Pat. No. 5,306,591, the disclosure of which is totally incorporated herein by reference, the image is developed with the liquid toner illustrated herein by, for example, immersion of the photoconductor therein, followed by transfer and fixing of the image.

Specific embodiments of the invention will now be described in detail. These Examples are intended to be illustrative, and the invention is not limited to the materials, conditions, or process parameters set forth in these embodiments. All parts and percentages are by weight unless otherwise indicated. Control Examples are also provided. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to give an ESA signal corresponding to a zeta potential of –26 millivolts for a 10 percent (v/v) suspension of LUDOX™ (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 and 700 centrifugal automatic particle analyzer, manufactured by Horiba Instruments, Inc., Irvine, Calif.

EXAMPLE II

MAGENTA LIQUID TONER CONCENTRATE 2[26270-9]

One hundred and sixty five and three tenths (165.3) grams of NUCREL 599® (a copolymer of ethylene and methacrylic acid with a melt index at 190° C. of 500 dg/minute, available from E.I. DuPont de Nemours & Company, Wilmington, Del.), 56.8 grams of the magenta pigment FANAL PINK™, 5.1 grams of aluminum stearate WITCO 22™

(Witco) and 307.4 grams of NORPAR 15®, carbon chain of 15 average (Exxon Corporation), were added to a Union Process 1S attritor (Union Process Company, Akron, Ohio) charged with 0.1875 inch (4.76 millimeters) diameter carbon steel balls. The mixture was milled at 125 rpm in the attritor which was heated to 83° C. to 96° C. for 2 hours by running steam through the attritor jacket and then an additional 980.1 grams of NORPAR 15® were added to the attritor and the attritor contents were cooled to 23° C. over 4 hours at a stir rate of 200 rpm by running cold water through the attritor jacket. An additional 1,532 grams of NORPAR 15® were added, and the mixture was separated by the use of a metal grate from the steel balls yielding a liquid toner concentrate of 7.19 percent solids wherein solids include resin, charge adjuvant, and pigment and 92.81 percent NORPAR 15®. The particle diameter was 2.02 microns average by area as measured with the Horiba Cappa 500. This toner concentrate was used to prepare developers of Controls 2, 3, and 4 and in Examples XV, XVI, and XVII.

EXAMPLE III

CYAN LIQUID TONER CONCENTRATE 3[26083-42]

Two hundred (200.0) grams of NUCREL 599® (a copolymer of ethylene and methacrylic acid with a melt index at 190° C. of 500 available from E.I. DuPont de Nemours & Company, Wilmington, Del.), 22.7 grams of the copper phthalocyanine cyan pigment (NBD-7010), 4.5 grams of aluminum stearate, WITCO 22™, (Witco Chemical Corporation, New York, N.Y.), and 1,287.5 grams of NORPAR 15® (Exxon Corporation) were added to a Union Process 1S attritor (Union Process Company, Akron, Ohio) charged with 0.1875 inch (4.76 millimeters) diameter carbon steel balls. The mixture was milled in the attritor which was heated up to 93° C. by running steam through the attritor jacket and after 2 hours the temperature had dropped to 62° C. while maintaining a stir rate of 125 rpm. Next, the attritor stir rate was increased to 200 rpm and the contents were cooled by running cold water through the attritor jacket while the temperature dropped to 16° C. over 4.0 hours. Additional (a total of 1,500 grams) NORPAR 15® was added, and the mixture was separated from the steel balls yielding a toner concentrate of 7.07 percent solids wherein solids include resin, charge adjuvant of aluminum stearate and pigment, and 92.93 percent NORPAR 15®. Particle size was determined with the Horiba Cappa 500 Particle size analyzer and was found to average by area 1.20 microns. This toner concentrate was used to prepare the developers of Control 5 and Example XVIII.

EXAMPLE IV

MAGENTA LIQUID TONER CONCENTRATE 4[26083-68]

One hundred and sixty five and three tenths (165.3 grams) of NUCREL 599® (a copolymer of ethylene and methacrylic acid with a melt index at 190° C. of 500 available from E.I. DuPont de Nemours & Company, Wilmington, Del.), 56.8 grams of the magenta pigment FANAL PINK™, 5.1 grams of aluminum stearate, WITCO 22™, (Witco Chemical Corporation, New York, N.Y.), and 307.4 grams of NORPAR 15® (Exxon Corporation) were added to a Union Process 1S attritor (Union Process Company, Akron, Ohio) charged with 0.1875 inch (4.76 millimeters) diameter carbon steel balls. The mixture was milled in the attritor, which was maintained between 85° and 95° C., by running steam through the attritor jacket at a stir rate of 125 rpm. Thereafter, 980.1 grams of NORPAR 15® were added to the contents of the attritor, the attritor stir rate was increased to 200 rpm, and the contents were cooled by running cold water through the attritor jacket while the temperature dropped to 23° C. over 4.5 hours. Additional (a total of 1,532.1 grams) NORPAR 15® was added, and the mixture was separated from the steel balls yielding a toner concentrate of 7.00 percent solids wherein solids include resin, charge adjuvant, and pigment and 93.00 percent NORPAR 15®. Particle size was determined with the Horiba Cappa 500 Particle size analyzer and was found to average by area 1.60 microns. This toner concentrate was used to prepare the developers of Control 6 and Example XIX.

EXAMPLE V

BASE POLYMER PREPARATION 1 [PREP FOR 99-2 PRE-QUAT]

Sequential Group Transfer Polymerization (GTP) of 2-ethylhexyl methacrylate (EHMA) and 2-dimethylaminoethyl methacrylate (DMAEMA) to prepare the AB diblock copolymer precursor of protonareal ammonium or quaternary ammonium block copolymer charge directors.

AB diblock copolymer precursors were prepared by a standard group transfer sequential polymerization procedure (GTP) wherein the ethylhexyl methacrylate monomer was first polymerized to completion and then the 2-dimethylaminoethyl methacrylate monomer was polymerized onto the living end of the ethylhexyl methacrylate polymer. All glassware was first baked out in an air convection oven at about 120° C. for about 16 to 18 hours.

In a typical procedure, a 2 liter 3-neck round bottom flask equipped with a magnetic stirring football, an Argon inlet and outlet and a neutral alumina (150 grams) column (later to be replaced by a rubber septum and then a liquid dropping funnel) was charged through the alumina column, which was maintained under a positive Argon flow and sealed from the atmosphere, with 415 grams (2.093 mole) of freshly distilled 2-ethylhexyl methacrylate (EHMA) monomer. Subsequently, 500 milliliters of freshly distilled tetrahydrofuran solvent, distilled from sodium benzophenone, was rinsed through the same alumina column into the polymerization vessel. Subsequently, the GTP initiator, 15 milliliters of methyl trimethylsilyl dimethylketene acetal (12.87 grams; 0.0738 mole) was syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.1 milliliter of a 0.66M solution of tetrabutylammonium acetate (catalyst) in the same dry tetrahydrofuran was syringed into the polymerization vessel. After an additional hour stirring under Argon, the polymerization temperature peaked at about 50° C. Shortly thereafter, 90 grams (0.572 mole) of freshly distilled 2-dimethylaminoethyl methacrylate (DMAEMA) monomer was dropwise added to the polymerization vessel. The polymerization solution was stirred under Argon for at least 4 hours after the temperature peaked. Then, 5 milliliters of methanol were added to quench the live ends of the fully grown copolymer. The above charges of initiator and monomers provide an $M_n$ and average degree of polymerization (DP) for each block. For the EHMA nonpolar B block, the charged $M_n$ was 5,621 and the DP was 28.3, and for the DMAEMA polar A block, the charged $M_n$ was 1,219 and the DP was 7.8. $^1$H-NMR analysis of a 20 percent (g/dl) $CDCl_3$ solution of the copolymer indicated a 77 to 78 mole percent EHMA content and a 22 to 23 mole percent DMAEMA content. GPC analysis was obtained on a fraction of the 1 to 2 gram sample of isolated polymer using three 250×8 millimeters of PHENOMENEX PHENOGEL™ columns in series (100, 500, 1,000 Angstroms) onto which was injected a 10 microliter sample of the block copolymer at 1 percent (weight/vol) in THF. The sample was eluted with THF at a flow rate of 1 milliliter/minute and the chromatogram was detected with a 254 nanometers UV detector. The GPC chromatogram was bimodal with the major peak occurring at 13.4 to 22.2 counts and the minor low molecular weight peak at 23.5 to 28.3 counts. The major peak had a polystyrene equivalent number average molecular weight ($M_n$) of 2,346 and a weight average molecular weight ($M_w$) of 8,398 (MWD=3.58). This GPC analysis of the AB diblock copolymer suggested the presence of low molecular weight oligomeric impurities. However, the low molecular weight GPC peak components do not appear to impair the charge director function of the subsequently prepared protonated ammonium AB diblock copolymer charge director.

A small (1 to 2 grams) portion of the AB diblock copolymer can be isolated for GPC and $^1$H-NMR analyses by precipitation into 10× its solution volume of methanol using vigorous mechanical agitation. The precipitated copolymer was then washed on the funnel with more methanol and was then dried overnight in vacuo (about 0.5 Torr) at about 50° C.

The AB diblock copolymer prepared above was not isolated, but instead was solvent exchanged to provide a copolymer solution in toluene. Typically, the methanol quenched copolymer solution in tetrahydrofuran was rotoevaporated at about 50° C. at reduced pressure (40 to 50 millimeters Hg) in a tared round bottom flask until no more solvent distilled over. Then, toluene was added to provide about a 50 percent by weight solution of the unprotonated block copolymer.

A hydrogen bromide protonated charge director was prepared from this AB diblock copolymer solution in toluene as described in Example VIII and methyl tosylate quaternized charge directors were also prepared from this AB diblock copolymer solution in toluene as described in Examples XI and XIII.

EXAMPLE VI

BASE POLYMER PREPARATION 2 [PREP FOR 99-1 PRE-QUAT]

A second AB diblock copolymer was prepared as described in Example V using the same polymerization procedure, conditions, and quantities of the same materials except that more ketene acetal was used to initiate the GTP. In this preparation, 26 milliliters of the ketene acetal (22.31 grams; 0.1280 mole) were used to initiate the polymerization. The above monomer charges were equivalent to 78.5 mole percent EHMA and 21.5 mole percent DMAEMA which corresponded to an EHMA average DP of 16.4 ($M_n$ of 3,243) and a DMAEMA average DP of 4.5 ($M_n$ of 703). After solvent exchange as described above, a 1 to 2 gram sample of the AB diblock copolymer was isolated by evaporating the toluene in a vacuum oven overnight (about 18 to 20 hours) at about 55° C. and 0.5 Torr, and the dried AB diblock copolymer was next sampled for $^1$H-NMR analysis. $^1$H-NMR analysis of a 20 percent (gram/dl) $CDCl_3$ solution of the AB diblock copolymer indicated about a 79 to 80 mole percent EHMA repeat unit content and a 20 to 21 mole percent DMAEMA repeat unit content. GPC analysis indicated the major peak at 14.5 to 19.9 counts to have a number average molecular weight of 3,912 and a weight average molecular weight of 6,222 (MWD of 1.59). Two barely discernible broad low molecular weight peaks were located at 20 to 25.1 and 25.1 to 30 counts.

EXAMPLE VII

BASE POLYMER PREPARATION 3 [PREP FOR 19-1 PRE-QUAT]

A third AB diblock copolymer was prepared as described in Example V using the same polymerization procedure and conditions except that the polymerization scale was increased by a factor of three. $^1$H-NMR analysis of a 17.5 percent (gram/dl) $CDCl_3$ solution of an isolated portion of the unprotonated block copolymer indicated about a 77 to 78 mole percent EHMA repeat unit content and a 22 to 23 mole percent DMAEMA repeat unit content. GPC analysis, reference Example V, indicated the major peak at 14.4 to 22.6 counts to have a number average molecular weight of 2,253 and a weight average molecular weight of 5,978 (MWD of 2.65). A broad low molecular weight peak was located at 24 to 32 counts. Two hydrogen bromide protonated charge directors were prepared from this AB diblock copolymer solution in toluene as described in Examples IX and X.

EXAMPLE IX

CHARGE DIRECTOR PREPARATION 2 [26242-56 FROM 125-19-1]

Preparation of the hydrogen bromide ammonium salt AB diblock copolymer charge director, poly[2-ethylhexyl methacrylate (B block)-co-N,N-dimethyl-N-ethyl methacrylate ammonium bromide (A block)], from poly[2-ethylhexyl methacrylate (B block)-co-N,N-dimethylamino-N-ethyl methacrylate (A block)] prepared in Example VII and aqueous hydrogen bromide: [Batch 2]

To a 1 liter single neck round bottom flask were added 98.31 grams of a 50.86 weight percent toluene solution of an AB diblock copolymer (50.0 grams) from poly(2-ethylhexyl methacrylate-co-N,N-dimethylamino-N-ethyl methacrylate) prepared in Example VII comprised of 18.23 weight percent of 2-dimethylaminoethyl methacrylate (DMAEIVIA) repeat units and 81.77 weight percent of 2-ethylhexyl methacrylate (EHMA) repeat units. The 50.0 grams of AB diblock copolymer contains 9.115 grams (0.05798 mole) of DMAEM A repeat units. To this magnetically stirred AB diblock copolymer toluene solution at about 22° C. were added 9.58 grams (0.05682 mole HBr) of 48 percent aqueous hydrobromic acid (Aldrich). The charged aqueous hydrobromic acid targeted 98.0 mole percent of the available DMAEMA repeat units in the AB diblock copolymer. The solution was magnetically stirred at ambient temperature for about 16 to 17 hours and was then diluted with NORPAR 15® (950 grams) to give a 5 weight percent (based on the corresponding starting weight of the AB diblock copolymer from Example VII) charge director solution after toluene and methanol rotoevaporation. Toluene and methanol were rotoevaporated at 50° to 60° C. for about 1 hour at 40 to 50 millimeters Hg from 200 gram portions of the charge director solution until the entire sample was rotoevaporated. The 5 weight percent NORPAR 15® solution of poly(2-ethylhexyl methacrylate-co-N,N-dimethyl-N-ethyl methacrylate ammonium bromide) was used to charge the liquid toner prepared in Example II and to formulate developers in Control 4 and Example XVII.

EXAMPLE X

CHARGE DIRECTOR PREPARATION 3[26242-81 FROM 125-19-1 PRE-QUAT]

Preparation of the hydrogen bromide ammonium salt AB diblock copolymer charge director, poly[2-ethylhexyl methacrylate (B block)-co-N,N-dimethyl-N-ethyl methacrylate ammonium bromide (A block)], from poly[2-ethylhexyl methacrylate (B block)-co-N,N-dimethylamino-N-ethyl methacrylate (A block)] prepared in Example VII and aqueous hydrogen bromide: [Batch 3].

To a 1 liter Erlenmeyer flask were added 294.93 grams of a 50.86 weight percent toluene solution of an AB diblock copolymer (150 grams) from poly(2-ethylhexyl methacrylate-co-N,N-dimethylamino-N-ethyl methacrylate) prepared in Example VII comprised of 18.23 weight percent 2-dimethylaminoethyl methacrylate (DMAEM A) repeat units and 81.77 weight percent 2-ethylhexyl methacrylate (EHMA) repeat units. The 150 grams of AB diblock copolymer contain 27.35 grams (0.174 mole) of DMAEMA repeat units. To this magnetically stirred AB diblock copolymer toluene solution at about 20° C. were added 28.73 grams (0.170 mole of HBr) of 48 percent aqueous hydrobromic acid (Aldrich). The charged aqueous hydrobromic acid targeted 98.0 mole percent of the available DMAEMA repeat units in the AB diblock copolymer. A 2° C. exotherm was observed in the first 5 minutes, but after the addition of 23.4 grams of methanol, an 8° C. exotherm was observed in the next five minutes, and then the temperature of the contents of the reaction vessel slowly began to drop. To reduce the viscosity of the reaction mixture, 150 grams of additional toluene were added to give a 33 weight percent solids solution of moderate viscosity. This solution was magnetically stirred for 20 hours at ambient temperature and was then diluted with NORPAR 15® (2,850 grams) to give a 5 weight percent (based on the corresponding starting weight of the AB diblock copolymer from Example VII) charge director solution after toluene and methanol rotoevaporation. Toluene and methanol were rotoevaporated at 50° to 60° C. for 1 to 2 hours at 40 to 50 millimeters Hg from 500 to 600 milliliter portions of the charge director solution until the entire sample was rotoevaporated. The 5 weight percent NORPAR 15® solution of poly(2-ethylhexyl methacrylate-co-N,N-dimethyl-N-ethyl methacrylate ammonium bromide) had a conductivity of 1,700 to 1,735 pmhos/centimeter and was used to charge liquid toner prepared in Example II and to formulate developers for Controls 2 and 3 and in Examples XV and XVI.

EXAMPLE XI

CHARGE DIRECTOR PREPARATION 4[25940-45 FROM 99-2 PRE-QUAT]

Preparation of the methyl rosylate quaternary ammonium AB diblock copolymer charge director, poly[2-ethylhexyl methacrylate (B block)-co-N,N,N-trimethyl-N-ethyl methacrylate ammonium tosylate (A block)], from poly[2-ethylhexyl methacrylate (B block)-co-N,N-dimethylamino-N-ethyl methacrylate (A block)] prepared in Example V and methyl tosylate: [Batch 1].

To a 500 milliliter 4 neck round bottom flask equipped with a mechanical stirrer, an Argon inlet and outlet on top of a water condenser, and a thermometer were charged 204.1 grams of the AB diblock copolymer toluene solution, prepared as described in Example V, and 110 grams of additional toluene solvent. This solution contained about 100 grams (49 weight percent solids) of the AB diblock copolymer of which 19.15 grams (0.1218 mole) were DMAEMA repeat units as determined by $^1$H-NMR. To this vigorously stirred solution at ambient temperature, and under a gentle Argon flow were added in one portion 20.4 grams (0.1096 mole) of methyl p-toluene sulfonate. The charged mole percent ratio of methyl p-toluene sulfonate to DMAEMA repeat units was 90 percent, thus nearly all of the DMAEMA repeat units have been targeted for conversion to the methyl p-toluene sulfonate quaternary ammonium AB diblock charge director. After about 1 hour, the internal temperature gently exothermed from 20° C. to 27° C. and then began to drop. After about 2 hours after the addition of the methyl p-toluene sulfonate, a heating mantle (set at 25 volts) was applied to the reaction vessel. An internal temperature of about 55° C. was maintained for the next 24 hours. A small aliquot (2.20 grams) of the methyl p-toluene sulfonate quaternary ammonium AB diblock charge director toluene solution was concentrated in the vacuum oven (50° to 55° C. for 28 hours at about 0.5 millimeter Hg) giving 0.78 gram of solid and establishing the solids level at 35.45 weight percent. To 6.79 grams of the 35.45 weight percent methyl p-toluene sulfonate quaternary ammonium AB diblock copolymer charge director solution (which contains 2.407 grams of quaternized AB diblock copolymer and 2.00 grams of the prequaternized AB diblock copolymer) were added 198 grams of NORPAR 15® and the mixture was rotoevaporated for about 1 hour at 50° to 60° C. at 40 to 60 millimeters Hg to remove the toluene. The 1 weight percent (based on the corresponding starting weight of the AB diblock copolymer from Example V) NORPAR 15® solution of poly(2-ethylhexyl methacrylate-co-N,N,N-trimethyl-N-ethyl methacrylate ammonium tosylate) was used to charge liquid toner prepared in Example III and to formulate developers for Control 5 and Example XVIII.

EXAMPLE XII

CHARGE DIRECTOR PREPARATION 5[26242-62 FROM 114-99-2 PRE-QUAT]

Preparation of the methyl tosylate quaternary ammonium AB diblock copolymer charge director, poly[2-ethylhexyl methacrylate (B block)-co-N,N,N-trimethyl-N-ethyl methacrylate ammonium tosylate (A block)], from poly[2-ethylhexyl methacrylate (B block)-co-N,N-dimethylamino-N-ethyl methacrylate (A block)] prepared in Example V and methyl rosylate: [Batch 2].

To 33.86 grams of the 35.45 weight percent methyl p-toluene sulfonate quaternary ammonium AB diblock copolymer charge director solution in toluene prepared in Example X were added 228.08 grams of NORPAR 15®. The 33.86 grams of the charge director solution contained 12.00 grams of methyl p-toluene sulfonate quaternized AB diblock copolymer, poly[2-ethylhexyl methacrylate (B block)-co-N,N,N-trimethyl-N-ethyl methacrylate ammonium rosylate (A block)], which corresponded to 9.97 grams of the prequaternized AB diblock copolymer, poly[2-ethylhexyl methacrylate (B block)-co-N,N-dimethylamino-N-ethyl methacrylate (A block)], prepared in Example V. The NORPAR 15®/toluene solution was rotoevaporated for about 1.5 hours at 50° to 60° C. at 40 to 60 millimeters Hg to remove the toluene. The 4.2 weight percent (based on the corresponding starting weight of the AB diblock copolymer from Example V) NORPAR 15® solution of poly(2-ethylhexyl methacrylate-co-N,N,N-trimethyl-N-ethyl methacrylate ammonium tosylate) was used to charge liquid toner prepared in Example III and to formulate developers in Control 5 and Example XVII.

EXAMPLE XIII

CHARGE DIRECTOR PREPARATION [BASIC BARIUM PETRONATE]

Basic barium petronate (BBP), available from Witco Chemical, was obtained as a concentrated mineral oil solution which was considered to be 100 percent solids. One part by weight of BBP was diluted with 9 parts by weight of NORPAR 15® (Exxon) to give a 10 percent BBP solution in NORPAR 15®. This 10 percent BBP solution was further diluted by taking one part by weight and diluting with 9 parts by weight of NORPAR 15® to give a 1 percent BBP solution in NORPAR 15®. Both solutions were used to charge liquid toner prepared in Example IV and to formulate developers in Control 6 and Example XIX.

CONTROL 2

A MAGENTA LIQUID DEVELOPER CHARGED WITH POLY[2-ETHYLHEXYL METHACRYLATE (B BLOCK)-CO-N,N-DIMETHYL-N-ETHYL METHACRYLATE AMMONIUM BROMIDE (A BLOCK)] WITHOUT ADDITIVE

A magenta liquid toner dispersion was prepared by selecting 27.82 grams of liquid toner concentrate (7.19 percent solids with the ink solids being thermoplastic resin, pigment, and charge adjuvant in NORPAR 15®) from Example II and adding to it 171.38 grams of NORPAR 15®, and 0.80 gram of charge director poly(2-ethylhexylmethacrylate-co-N,N-dimethyl-N-ethyl methacrylate ammonium bromide) (5.00 percent solids in NORPAR 15®) from Example X. This preparation resulted in 200 grams of a magenta liquid toner dispersion of 1 percent solids and 20 milligrams of charge director to 1 gram of toner solids or 2.0 percent charge director per gram of toner solids. The mobility and conductivity of the toner were measured after 14 days of charging and were compared to the corresponding values of the 1 percent liquid toners of Example XV containing cyclic sulfone or sulfoxide additives after 15 days of charging. The charging and conductivity results for the Control 2 magenta liquid developer and the four comparative liquid developers prepared in Example XV are described in Table 4 and the formulations for all five (Control 2 and four of Example XV) developers are provided in Table 3. Both tables are in Example XV.

EXAMPLE XV

MAGENTA LIQUID DEVELOPERS CHARGED WITH POLY[2-ETHYLHEXYL METHACRYLATE (B BLOCK)-CO-N,N-DIMETHYL-N-ETHYL METHACRYLATE AMMONIUM BROMIDE (A BLOCK)] WITH CYCLIC SULFONE AND SULFOXIDE ADDITIVES

Four magenta liquid toner dispersions (developers) at 1 percent toner solids in NORPAR 15® were prepared by mixing the components in Table 3 wherein the first three developers were charged at 20/1 milligrams of CD (charge director) to 1 gram of toner solids or 2 percent CD per gram of toner solids, and the last developer was charged at 30/1 milligrams of CD to 1 gram of toner solids or 3 percent CD per gram of toner solids. In all Example XV developers, the same CD (from Example X) and amount as were used in Control 2 were selected. In addition, the Example XV developers were also equilibrated with 0.3 weight percent additive (based on the total 200 gram weight of the developer) as described in Table 3.

TABLE 3

Magenta Toner Formulations for Controls 2 and Example XV Developers

| Developer 1% in Toner Solids | Grams Toner Conc. from Example II | Grams Norpar 15 Diluent | Grams 5% CD from Example X (mg CD/g Toner Solids-Initial) | Grams 5% CD from Example X CD for Bump-up (mg CD/g Toner Solids-Final) | Grams and Kind of Additive in Developer at 0.3% |
|---|---|---|---|---|---|
| Control 2 | 27.82 | 171.38 | 0.80 (20/1) | 1.6 (60/1) | none |
| Example XV-1 | 27.82 | 170.78 | 0.80 (20/1) | 1.6 (60/1) | 0.6 of 3-methyl sulfolane |
| Example XV-2 | 27.82 | 170.78 | 0.80 (20/1) | 1.6 (60/1) | 0.6 of 2,4-dimethyl sulfolane |
| Example XV-3 | 27.82 | 170.78 | 0.80 (20/1) | 1.6 (60/1) | 0.6 of butadiene sulfone |
| Example XV-4 | 27.82 | 170.38 | 1.20 (30/1) | 1.2 (60/1) | 0.6 of tetra-methylene sulfoxide |

After charge equilibrating for 15 days with CD and additive present, the ESA time-series measurement was applied to the Example XV developers to determine charging rate and conductivity. These results along with the Control 2 result are described in Table 4.

TABLE 4

Impact of Cyclic Sulfone and Sulfoxide Additives on Magenta Developers Containing Poly[2-ethylhexyl methacrylate (B Block)-co-N,N-dimethyl-N-ethyl methacrylate ammonium bromide (A Block)] Charge Director

| Developer: Age and Additive Status at Initial CD Conc. | Toner Conc. and Example No. | Additive Level and Mode of Addition to Developer & CD Example No. | ESA Time-Series Data: Mobilities in $m^2/Vs \times -1\ E^{-10}$ (Conductivities in pmho/cm) Change in CD Conc. in mg/g | Comments |
|---|---|---|---|---|
| Control 2 14 days at 20/1 CD w/o additive | Example II Magenta | No additive throughout; $CD_{initial\ \&\ added}$ Example X | 0.19(1)→1.00(12)→1.15(11) time 0 3 min. 15 min. 20/1 60/1 60/1 no additive→→→→→→→ | Medium mobility in 15 min.; no additive |
| Example XV-1 15 days at 20/1 CD with additive | Example II Magenta | 0.3% 3-methyl-sulfolane in developer for 15 days prior to CD bump-up $CD_{initial\ \&\ added}$ Example X | 0.22(1)→2.15(15)→2.80(14) time 0 3 min 15 min. 20/1 60/1 60/1 + additive→→→→→→→→ | High mobility in 3 and 15 minutes |
| Example XV-2 15 days at 20/1 CD with additive | Example II Magenta | 0.3% 2,4-dimethyl-sulfolane in developer for 15 days prior to CD bump-up $CD_{initial\ \&\ added}$ Example X | 0.19(1)→1.85(14)→2.70(13) time 0 3 min. 15 min. 20/1 60/1 60/1 + additive→→→→→→→→ | High mobility in 3 and 15 minutes |
| Example XV-3 15 days at 20/1 CD with additive | Example II Magenta | 0.3% butadiene sulfone in developer for 15 days prior to CD bump-up $CD_{initial\ \&\ added}$ Example X | 0.22(1)→1.00(15)→1.40(13) time 0 3 min. 15 min. 20/1 60/1 60/1 + additive→→→→→→→→ | Slightly higher mobility in 15 min.; additive not totally soluble in developer |
| Example XV-4 15 days at 30/1 CD with additive | Example II Magenta | 0.3% tetramethyl-ene sulfoxide in developer or 15 days prior to CD bump-up $CD_{initial\ \&\ added}$ Example X | 0.21(1)→→→→→→→→2.18(5) time 0 20 min 30/1 60/1 + additive→→→→→→→→ | High mobility in 20 min. |

A review of the mobility data in Table 4 indicates that Control 2, which contained no additive, failed to reach a high mobility in 15 minutes after the charge director concentration had been bumped-up to 60/1 milligrams of CD to 1 gram of toner solids or 6 percent CD per gram of toner solids. Except for Example XV-3 in which the developer was observed to contain insoluble solid additive after 15 days, the other Example XV developers (XIII-1, 2 and 4) all reached high mobilities in only 3 minutes indicating that the additive was accelerating the liquid toner charging rate versus the Control 2 developer without additive. It is important, however, that the additive be soluble at the low concentrations used in these developers or it otherwise is a much less effective additive for increasing the charging rate. For example, the soluble cyclic sulfone additives of Examples XV-1 and XV-2 developer in 15 minutes after the CD bump-up cause mobility (proportional to charging rate) rate increases of 2 to 3 times that of the Control 2 developer also for 15 minutes after CD bump-up. The less soluble cyclic sulfone in Example XV-3, however, increases mobility by only a factor of 1.2 times. The presence of alkyl substituents on the additive ring structure assists in solubilizing these additives but alkyl substituents are not always required to obtain sufficient additive solubility in the liquid toner hydrocarbon diluents used in formulating these developers.

CONTROL 3

A MAGENTA LIQUID DEVELOPER CHARGED WITH POLY[2-ETHYLHEXYL METHACRYLATE (B BLOCK)-CO-N,N-DIMETHYL-N-ETHYL METHACRYLATE AMMONIUM BROMIDE (A BLOCK)] WITHOUT ADDITIVE

A second batch of magenta liquid toner dispersion was prepared as described in Control 2 by selecting 27.82 grams of liquid toner concentrate (7.19 percent solids with the ink solids being thermoplastic resin, pigment, and charge adjuvant in NORPAR 15®) from Example II and adding to it 171.18 grams of NORPAR 15®, and 1.00 gram of charge director poly(2-ethylhexylmethacrylate-co-N,N-dimethyl-N-ethyl methacrylate ammonium bromide) (5.00 percent solids in NORPAR 15®) from Example X. This preparation resulted in 200 grams of a magenta liquid toner dispersion of 1 percent solids and 25 milligrams of charge director to 1 gram of toner solids or 2.5 percent charge director per gram of toner solids. The mobility and conductivity of the toner were measured after 13 days of charging and were compared to the corresponding values of the 1 percent liquid toners of Example XVI containing amide additives after 13 or 14 days of charging. The charging and conductivity results for the Control 3 magenta liquid developer and the four comparative liquid developers prepared in Example XVI are described in Table 6 and the formulations for all five (Control 3 and four Example XVI) developers are provided in Table 5. Both tables follow Example XVI.

EXAMPLE XVI

MAGENTA LIQUID DEVELOPERS CHARGED WITH POLY[2-ETHYLHEXYL METHACRYLATE (B BLOCK)-CO-N,N-DIMETHYL-N-ETHYL METHACRYLATE AMMONIUM BROMIDE (A BLOCK)] WITH AMIDE ADDITIVES

Four magenta liquid toner dispersions (developers) at 1 percent toner solids in NORPAR 15® were prepared by mixing the components in Table 5 wherein the first three developers were charged at 25/1 milligrams of CD to 1 gram of toner solids or 2.5 percent CD per gram of toner solids and the last listed developer was charged at 30/1 milligrams of CD to 1 gram of toner solids or 3.0 percent CD per gram of toner solids. In all Example XVI developers the same CD (from Example X) and amount as was used in Control 3, Control 2, and Example XV were selected. In addition the Example XVI developers were also equilibrated with 0.3 weight percent amide additive (based on the total 200 gram weight of the developer), reference Table 5.

TABLE 5

Magenta Toner Formulations for Control 3 and Example XVI Developers

| Developer 1% in Toner Solids | Grams Toner Conc. from Example II | Grams Norpar 15 Diluent | Grams 5% CD from Example X (mg CD/g Toner Solids-Initial) | Grams 5% CD from Example X CD for Bump-up (mg CD/g Toner Solids-Final) | Grams and Kind of Additive in Developer at 0.3% |
|---|---|---|---|---|---|
| Control 3 | 27.82 | 171.18 | 1.00 (25/1) | 1.4 (60/1) | none |
| Example XVI-1 | 27.82 | 170.58 | 1.00 (25/1) | 1.4 (60/1) | 0.6 of N,N-dimethyl-formamide |
| Example XVI-2 | 27.82 | 170.58 | 1.00 (25/1) | 1.4 (60/1) | 0.6 of N,N-dimethyl-acetamide |
| Example XVI-3 | 27.82 | 170.58 | 1.00 (25/1) | 1.4 (60/1) | 0.6 of N-methyl-pyrrolidone |
| Example XVI-4 | 27.82 | 170.38 | 1.00 (30/1) | 1.2 (60/1) | 0.6 of N-t-butyl-formamide |

After charge equilibrating for 13 or 14 days days with CD and amide additive present, the ESA time-series measurement was applied to the Example XIV developers to determine charging rate and conductivity. These results together with the Control 3 result are described in Table 6.

Inspection of the mobility data in Table 6 indicates that Control 3, which contained no additive, failed to reach a high mobility in 15 minutes after the charge director concentration had been bumped-up to 60/1 milligrams of CD to 1 gram of toner solids or 6 percent CD per gram of toner solids. All Example XVI developers (XVI-1-4) reached high mobilities in 15 minutes after CD bump-up but the developer containing the cyclic tertiary amide N-methylpyrrolidone additive reached high mobility in only 3 minutes after CD bump-up. The developer containing the N-t-butylformamide additive reached high mobility in only 0.17 minute after CD bump-up indicating that the presence of this additive resulted in a developer which increased mobility rate (or charging rate) very rapidly versus the same Control 3 developer containing no additive. The XVI-4 developer in a 0.17 minute after the CD bump-up caused a mobility (proportional to charging rate) rate increase of 71 times that of the Control 3 developer measured 3 minutes after CD bump-up. For the other Example XVI (XVI-1-3) developers, the mobility rate increased in 15 minutes after the CD bump-up was about 2 to 3 times that of the Control 3 developer also at 15 minutes after the CD bump-up. It is believed that the N-t-butylformamide increased the charging rate more because it has the highest dielectric constant of all the additives in Example XVI. All four additives were readily soluble in the developer at the concentrations used herein.

TABLE 6

Impact of Amide Additives on Magenta Developers Containing Poly[2-ethylhexyl methacrylate (B Block)-co-N,N-dimethyl-N-ethyl methacrylate ammonium bromide (A Block)] Charge Director

| Developer: Age and Additive Status at Initial CD Conc. | Toner Conc. and Example No. | Additive Level and Mode of Addition to Developer and CD Example No. | ESA Time-Series Data: Mobilities in $m^2/Vs \times -1\ E^{-10}$ (Conductivities in pmho/cm) Change in CD Conc. in mg/g | Comments |
|---|---|---|---|---|
| Control 3 13 days at 25/1 CD w/o additive | Example II Magenta | No additive throughout; $CD_{initial\ \&\ added}$ Example IX | 0.11(1)→0.75(12)→0.90(12 time 0 3 min. 15 min. 25/1 60/1 60/1 no additive→→→→→→→ | Medium mobility in 15 min.; no additive |
| Example XVI-1 13 days at 25/1 CD with additive | Example II Magenta | 0.3% N,N-dimethyl-formamide in developer 13 days prior to CD bump-up $CD_{initial\ \&\ added}$ Example IX | 0.14(1)→1.60(15)→2.50(14 time 0 3 min. 15 min. 25/1 60/1 60/1 + →→→→→→→→→ | Medium mobility in 3 min.; High mobility in 15 min. |
| Example XVI-2 13 days at 25/1 CD with additive | Example II Magenta | 0.3% N,N-dimethyl-acetamide in developer for 13 days prior to CD bump-up $CD_{initial\ \&\ added}$ Example IX | 0.22(1)→1.40(15)→2.25((14) time 0 3min. 15 min. 25/1 60/1 60/1 + additive→→→→→→→→→ | Medium mobility in 3 min.; High mobility in 15 min. |
| Example XVI-3 13 days at 25/1 CD with additive | Example II Magenta | 0.3% N-methyl-pyrrolidone in developer for 13 days prior to CD bump-up $CD_{initial\ \&\ added}$ Example IX | 0.20(1)→2.10(17)→2.70(14) time 0 3 min. 15 min. 25/1 60/1 60/1 + additive→→→→→→→→→ | High mobility in 3 & 15 min. |
| Example XVI-4 14 days at 25/1 CD with additive | Example II Magenta | 0.3% N-t-butyl-formamide in developer for 14 days prior to CD bump-up $CD_{initial\ \&\ added}$ Example IX | 0.02(2)→2.60(18)→2.59(16) time 0 0.17 min. 20 min. 30/1 60/1 + additive→→→→→→→→→ | High mobility in 0.17 & 20 min. |

CONTROL 4

A MAGENTA LIQUID DEVELOPER CHARGED WITH POLY[2-ETHYLHEXYL METHACRYLATE (B BLOCK)-CO-N,N-DIMETHYL-N-ETHYL METHACRYLATE AMMONIUM BROMIDE (A BLOCK)] WITHOUT ADDITIVE AS A BACKGROUND CONTROL

A large batch (1,500 grams) of a magenta liquid toner dispersion (developer) was prepared by selecting 208.62 grams of liquid toner concentrate (7.19 percent solids with the ink solids being thermoplastic resin, pigment, and charge adjuvant in NORPAR 15®) from Example II and adding to it 1,273.80 grams of NORPAR 15®, and 6.00 grams of charge director poly(2-ethylhexylmethacrylate-co-N,N-dimethyl-N-ethyl methacrylate ammonium bromide) (5.00 percent solids in NORPAR 15®) from Example IX. This preparation resulted in 1,488.00 grams of a magenta liquid toner dispersion of 1 percent solids charged at 20 milligrams of charge director to 1 gram of toner solids or 2.0 percent charge director per gram of toner solids. In the CD concentration bump-up, an additional 12 grams of Example IX CD solution were added to bring the total developer weight to 1,500 grams. The charging and conductivity results for the Control 4 magenta liquid developer and the two comparative liquid developers prepared in Example XVII are described in Table 8 and the formulations for all three (Control 4 and two Example XVII) developers are provided in Table 7. Table 9 describes reflectance density data which was measured using a Macbeth densitometer model RD918. The data was obtained from transparent tape transfers from a solid area patch on the photoreceptor (image density) and from the area immediately adjacent to it (background). A Savin 870 liquid development machine set to develop negative toner was used to obtain print samples from both the Control 4 developer and from the two Example XVII developers. The three Tables 7, 8 and 9 follow Example XVII.

EXAMPLE XVII

MAGENTA LIQUID DEVELOPERS CHARGED WITH POLY[2-ETHYLHEXYL METHACRYLATE (B BLOCK)-CO-N,N-DIMETHYL-N-ETHYL METHACRYLATE AMMONIUM BROMIDE (A BLOCK)] WITH SULFOLANE AND BUTYLENE CARBONATE ADDITIVES FOR BACKGROUND IMPROVEMENT

Two magenta liquid toner dispersions (developers) at 1 percent toner solids in NORPAR 15® were prepared by mixing the components in Table 7 wherein both developers were charged at 20/1 milligrams of CD to 1 gram of toner solids or 2.0 percent CD per gram of toner solids. In all Example XVII developers, the same CD (from Example IX) and amount were used as in Control 4. Only the two Example XVII developers were equilibrated with additive and Control 4 contained no additive. For Example XVII-1, 0.2 percent of sulfolane was first equilibrated in the developer for 9 days and for Example XVII-2, 0.3 percent of butylene carbonate, 4,5-dimethyl-1,3-dioxalan-2-one, (Texaco Chemical Company) was equilibrated in the developer for the same time period. The percentage additive was by weight and was based on the total weight (1,500 grams) of developer after all the CD had been added as described in Table 7.

TABLE 7

Magenta Toner Formulations for Control 4 and Example XV Developers

| Developer 1% in Toner Solids | Grams Toner Conc. from Ex. II | Grams Norpar 15 Diluent | Grams 5% CD from Ex. VIII (mg CD/g Toner Solids-Initial) | Grams 5% CD from Ex. VIII CD for Bump-up (mg CD/g Toner Solids-Final) | Grams and Kind of Additive in Developer [% Conc.] |
|---|---|---|---|---|---|
| Control 4 | 208.62 | 1273.38 | 6.00 (20/1) | 12.00 (60/1) | none |
| Example XVII-1 | 208.62 | 1273.38 | 6.00 (20.1) | 12.00 (60/1) | 3.1 of sulfolane [0.2] |
| Example XVII-2 | 208.62 | 1273.38 | 6.00 (20/1) | 12.00 (60/1) | 4.5 of butylene carbonate [0.3] |

After charge equilibrating the Control 4 developer without additive for 9 days and the two Example XVII developers with additive also for 9 days, the CD concentration was increased in an ESA time-series measurement to determine charging rate over 15 minutes and conductivity. These results are described in Table 8.

TABLE 8

Impact of Sulfolane and Butylene Carbonate Additives on Magenta Developers Containing Poly[2-ethylhexyl methacrylate (B Block)-co-N,N-dimethyl-N-ethyl methacrylate ammonium bromide (A Block)] Charge Director

| Developer: Age and Additive Status at Initial CD Conc. | Toner Conc. and Example No. | Additive Level and Mode of Addition to Developer and CD Example No. | ESA Time-Series Data: Mobilities in $m^2/Vs \times -1\ E^{-10}$ (Conductivities in pmho/cm) Change in CD Conc. in mg/g | Comments |
|---|---|---|---|---|
| Control 4 9 days at | Example II Magenta | No additive throughout; | 0.03(1)→→→→→→1.43(15) time 0 15 min. | Medium mobility |

TABLE 8-continued

Impact of Sulfolane and Butylene Carbonate Additives on Magenta Developers Containing Poly[2-ethylhexyl methacrylate (B Block)-co-N,N-dimethyl-N-ethyl methacrylate ammonium bromide (A Block)] Charge Director

| Developer: Age and Additive Status at Initial CD Conc. | Toner Conc. and Example No. | Additive Level and Mode of Addition to Developer and CD Example No. | ESA Time-Series Data: Mobilities in $m^2/Vs \times -1\ E^{-10}$ (Conductivities in pmho/cm) Change in CD Conc. in mg/g | Comments |
|---|---|---|---|---|
| 20/1 CD w/o additive Example XVII-1 9 days at 20/1 CD with additive | Example II Magenta | $CD_{initial\ \&\ added}$ Example VIII 0.2% sulfolane in developer for 9 days prior to CD bump-up | 20/1 60/1<br>no additive→→→→→→→→<br>0.24(1)→→→→→→→2.68(18)<br>time 0 15 min.<br>20/1 60/1<br>+ additive→→→→→→→→→ | in 15 min.; no additive High mobility in 15 min. with additive |
| Example XVII-2 9 days at 20/1 CD with additive | Example II Magenta | $CD_{initial\ \&\ added}$ Example VIII 0.3% butylene carbonate in developer for 9 days prior to CD bump-up | 0.12(1)→→→→→→→2.77(17)<br>time 0 15 min.<br>20/1 60/1<br>+ additive→→→→→→→→→ | High mobility in 15 min. with additive |

Inspection of Table 8 indicates that the two Example XVII developers containing additives charged to almost 2 times the mobility level of the Control 4 developer without additive after 15 minutes following the charge director concentration (CD) bump-up from 20/1 to 60/1. The additives were thus beneficial in increasing the charging rate of these developers.

The developers formulated in Table 7 were subjected to a reflective density measurement using a Macbeth densitometer model RD918. Table 9 describes the reflectance density data obtained from transparent tape transfers from a solid area patch on the photoreceptor (image density) and from the area immediately adjacent to it (background). A Savin 870 liquid development machine set to develop negative toner was used to obtain print samples both from the Control 4 developer and from the two Example XVII developers.

TABLE 9

Background Decrease from Sulfolane and Butylene Carbonate Additives in Magenta Developers Containing Poly[2-ethylhexyl methacrylate (B Block)-co-N,N-dimethyl-N-ethyl methacrylate ammonium bromide (A Block)] Charge Director

| Developer: Age and Additive Status at Initial CD Conc. | Toner Conc. & Example No. | Additive Level & Mode of Addition to Developer and CD Ex. No. | CD Level mg/g | Time After CD Increase | Solid Area Patch Density on Paper | Background Density on Tape | Comments |
|---|---|---|---|---|---|---|---|
| Control 4 9 days at 20/1 w/o additive | Example II Magenta | No additive throughout; $CD_{i\&a}$ = Example IX | 20/1<br>60/1<br>60/1<br>60/1 | 0<br>1 min.<br>10 min.<br>6 days | 0.74<br>1.07<br>1.15<br>0.85 | 0.16<br>0.10<br>0.11<br>0.03 | Background improves significantly at some time >10 min. |
| Example XVII-1 9 days at 20/1 with additive | Example II Magenta | 0.2% sulfolane in developer for 9 days prior to CD bump-up $CD_{i\&a}$ = | 20/1<br>60/1<br>60/1<br>60/1 | 0<br>1 min.<br>10 min.<br>6 days | 0.52<br>0.92<br>1.03<br>0.97 | 0.19<br>0.06<br>0.03<br>0.04 | Background improves significantly after 1 min. |

TABLE 9-continued

Background Decrease from Sulfolane and Butylene Carbonate Additives in Magenta Developers Containing Poly[2-ethylhexyl methacrylate (B Block)-co-N,N-dimethyl-N-ethyl methacrylate ammonium bromide (A Block)] Charge Director

| Developer: Age and Additive Status at Initial CD Conc. | Toner Conc. & Example No. | Additive Level & Mode of Addition to Developer and CD Ex. No. | CD Level mg/g | Time After CD In-crease | Solid Area Patch Den-sity on Paper | Back-ground Density on Tape | Comments |
|---|---|---|---|---|---|---|---|
| Example XVII-2 9 days at 20/1 with additive | Example II Magenta | Example IX 0.3% butylene carbonate for 9 days prior to CD bump-up $CD_{i\&a}$ = Example IX | 20/1<br>60/1<br>60/1<br>60/1 | 0<br>1 min.<br>10 min.<br>6 days | 0.76<br>0.93<br>0.92<br>0.86 | 0.07<br>0.03<br>0.03<br>0.04 | Background improves significantly after 1 min. |

Inspection of Table 9 indicates that the background density measured adjacent to the solid area patch on the photoreceptor was significantly decreased after 1 minute for the Example XVII developers containing additives but not for the Control 4 developer containing no additive. It is believed that the additive accelerates the conversion of neutral toner to negatively charged toner thereby reducing background adjacent to the solid density patch.

CONTROL 5

A CYAN LIQUID DEVELOPER CHARGED WITH POLY [2-ETHYLHEXYL METHACRYLATE (B BLOCK)-CO-N,N,N-TRIMETHYL-N-ETHYL METHACRYLATE AMMONIUM TOSYLATE (A BLOCK)] WITHOUT ADDITIVE

A 1,500 gram sample of liquid toner dispersion was prepared by selecting 212.2 grams of liquid toner concentrate (7.07 percent solids in NORPAR 15® with the ink solids being thermoplastic resin, pigment, and charge adjuvant) from Example III and adding to it 1,227.8 grams of NORPAR 15™, and 60.0 grams of charge director (1 percent solids in NORPAR 15®) prepared in Example XI. This resulted in a liquid toner dispersion of 1 percent toner solids and 40 milligrams of charge director (CD) to 1 gram of toner solids or 4.0 percent CD per gram of toner solids. After ambient storage of this developer for 168 days, a 200 gram sample was withdrawn as Control 5 and the charge director concentration was subsequently bumped-up to 73/1 by adding 1.6 grams of a second batch of the same charge director (4.2 percent solids in NORPAR 15®) prepared in Example XII. The additive was contained in the 1.6 grams of charge director bump-up solution. The charging and conductivity results for the Control 5 cyan liquid developer and the five comparative liquid developers prepared in Example XVIII are described in Table 11 and the formulations for all six (Control 5 and two Example XVIII) 200 gram developers are provided in Table 10. Both Tables follow Example XVIII.

EXAMPLE XVIII

CYAN LIQUID DEVELOPERS CHARGED WITH POLY [2-ETHYLHEXYL METHACRYLATE (B BLOCK)-CO-N,N.N-TRIMETHYL-N-ETHYL METHACRYLATE AMMONIUM TOSYLATE (A BLOCK)] CONTAINING SULFOLANE AND CYCLIC ALKYLENE CARBONATE ADDITIVES

A cyan liquid toner dispersion (developer) at 1 percent toner solids in NORPAR 15® was prepared as a 1,500 gram masterbatch described in Control 5. To each of five 200 gram developer portions of the above cyan masterbatch developer were added 1.6 grams of the same charge director (4.2 percent in NORPAR 15® prepared in Example XII) used to bump-up the Control 5 developer. The Control 5 and the Example XVIII developers all contained an initial charge director (CD) concentration of 40 milligrams of CD to 1 gram of toner solids or 4.0 percent CD per gram of toner solids which after 168 days of ambient storage were bumped-up to 73 milligrams of CD to 1 gram toner solids or 7.3 percent CD per gram of toner solids. Each additive at the chosen concentration based on the 200 gram weight of developer was contained in the 1.6 grams of charge director bump-up solution for about 1 hour prior to the addition of the CD solution to the cyan developers. The polar organic additives were butylene carbonate, propylene carbonate TEXACAR® PC, and ethylene carbonate TEXACAR® EC, all available from the Texaco Chemical Company. The additives were miscible in the CD solution after 1 hour of ambient agitation except for ethylene carbonate which was not totally soluble in the CD solution. Solid ethylene carbonate was allowed to settle out and the supernatant solution was used to bump-up the cyan developer. Thus, the ethylene carbonate additive was present in the developer at some concentration less than 0.1 percent. The Tables summarize the formulations for the Example XVIII toners and the Control 5 toner.

TABLE 10

Cyan Toner Formulations for Control 5 and Example XVIII Developers

| Developer 1% in Toner Solids | Grams 1% Developer from Control 5 Masterbatch (mg CD/g Toner Solids-Initial) | Grams 4.2% CD from Ex. XII CD for Bump-up (mg CD/g Toner Solids-Final) | Grams and Kind of Additive [% Conc. in Developer] Additive Added in CD Bump-up Solution |
|---|---|---|---|
| Control 5 | 200.00 (at 40/1) | 1.6 (73/1) | none |
| Example XVIII-1 | 200.00 (at 40/1) | 1.6 (73/1) | 0.4 of sulfolane [0.2] |
| Example XVIII-2 | 200.00 (at 40/1) | 1.6 (73/1) | 0.4 of butylene carbonate [0.2] |
| Example XVIII-3 | 200.00 (at 40/1) | 1.6 (73/1) | 0.6 of butylene carbonate [0.3] |
| Example XVIII-4 | 200.00 (at 40/1) | 1.6 (73/1) | 0.4 of propylene carbonate [0.2] |
| Example XVIII-5 | 200.00 (at 40/1) | 1.6 (73/1) | <0.2 of ethylene carbonate [<0.1] |

Inspection of Table 11 indicates that in 0.7 hour the five Example XVIII developers containing additives underwent only an 18 to 32 percent loss in mobility when the CD concentration was bumped-up versus about a 49 percent loss in mobility for the Control 5 developer containing no additive. The additives are beneficial in increasing the charging rate of the Example XVIII developers such that more of the original charge was rapidly regained in 0.7 hour when additive was present versus the Control 5 developer when additive was absent.

TABLE 11

Impact of Sulfolane and Cyclic Alkylene Carbonate Additives on Cyan Developers Containing Poly[2-ethylhexyl methacrylate-co-N,N,N-trimethyl-N-ethyl methacrylate ammonium tosylate] Charge Director

| Developer: Age and Additive Status at Initial CD Conc. | Toner Conc. and Ex. No. | Additive Level and Mode of Addition to Developer and CD Example No. | ESA Time-Series Data: Mobilities in $m^2/Vs \times -1\ E^{-10}$ (Conductivities in pmho/cm) Change in CD Conc. in mg/g | Comments |
|---|---|---|---|---|
| Control 5 168 days at 40/1 CD w/o additive | Example III Cyan | No additive throughout; $CD_i$ = Ex. XI $CD_a$ = Ex. XII | 2.58(7)→→→→→1.32(10) time 0 0.7 hr. 40/1 73/1 no additive→→→→→→→ | −48.8% mobility loss in absence of additive |
| Example XVIII-1 168 days at 40/1 CD w/o additive | Example III Cyan | None to start; 0.2% sulfolane added to CD for 1 hr. prior to bump-up $CD_i$ = Ex. XI $CD_a$ = Ex. XII | 3.08(10)→→→→→2.09(30) Time 0 0.7 hr. 40/1 73/1 no additive + additive | −32.1% mobility loss with equilibrated additive |
| Example XVIII-2 168 days at 40/1 CD w/o additive | Example III Cyan | None to start; 0.2% butylene carbonate added to CD for 1 hr prior to bump-up $CD_i$ = Ex. XI $CD_a$ = Ex. XII | 2.99(7)→→→→→2.45(24) time 0 0.7 hr. 40/1 73/1 no additive + additive | −18.1% mobility loss with equilibrated additive |
| Example XVIII-3 168 days at 40/1 CD w/o additive | Example III Cyan | None to start; 0.3% butylene carbonate added to CD for 1 hr prior to bump-up $CD_i$ = Ex. XI $CD_a$ = Ex. XII | 2.87(7)→→→→→2.24(21) time 0 0.7 hr. 40/1 73/1 no additive + additive | −22.0% mobility loss with equilibrated additive |
| Example XVIII-4 168 days at 40/1 CD | Example III Cyan | None to start; 0.2% propylene carbonate added to CD | 3.04(7)→→→→→2.21(16) time 0 0.7 hr. 40/1 73/1 no additive + additive | −27.3% mobility loss with equilibrated |

TABLE 11-continued

Impact of Sulfolane and Cyclic Alkylene Carbonate Additives on Cyan Developers Containing Poly[2-ethylhexyl methacrylate-co-N,N,N-trimethyl-N-ethyl methacrylate ammonium tosylate] Charge Director

| Developer: Age and Additive Status at Initial CD Conc. | Toner Conc. and Ex. No. | Additive Level and Mode of Addition to Developer and CD Example No. | ESA Time-Series Data: Mobilities in $m^2/Vs \times -1\ E^{-10}$ (Conductivities in pmho/cm) Change in CD Conc. in mg/g | | Comments |
|---|---|---|---|---|---|
| w/o additive | | for 1 hr. prior to bump-up $CD_i$ = Ex. XI $CD_a$ = Ex. XII | | | additive |
| Example XVIII-5 168 days at 40/1 CD w/o additive | Example III Cyan | None to start; 0.1% ethylene carbonate added to CD for 1 hr. prior to bump-up $CD_i$ = Ex. XI $CD_a$ = Ex. XII | 3.14(7)→→→→→2.24(13) time 0 40/1 no additive | 0.7 hr. 73/1 + additive | −28.7% mobility loss with equilibrated additive |

CONTROL 6

A MAGENTA LIQUID DEVELOPER CHARGED WITH BASIC BARIUM PETRONATE WITHOUT ADDITIVE

A magenta liquid toner dispersion was prepared by selecting 214.3 grams of liquid toner concentrate (7.00 percent solids with the ink solids being thermoplastic resin, pigment, and charge adjuvant in NORPAR 15®) from Example IV and adding to it, 1,281.2 grams of NORPAR 15®, and 4.50 grams of charge director basic barium petronate (BBP) (10.00 percent solids in NORPAR 15®) from Example XIII. This preparation resulted in 1,500 grams of a magenta liquid toner dispersion masterbatch of 1 percent solids and 30 milligrams of BBP charge director (CD) to 1 gram of toner solids or 3.0 percent CD per gram of toner solids. The mobility and conductivity of the toner were measured after 28 days of charging and were compared to the corresponding values of the 1 percent liquid toners of Example XIX containing sulfolane or cyclic alkylene carbonate additives which were allowed to equilibrate in the same developer for about 3 days prior to the charge director (CD) bump-up from 30/1 to 36/1 milligrams of CD to 1 gram of toner solids. All ESA mobility measurements in Control 6 and Example XIX were performed on 200 gram portions of the magenta masterbatch developer. The charging and conductivity results for the Control 6 magenta liquid developer and the four comparative liquid developers prepared in Example XIX are described in Table 13 and the formulations for all five (Control 6 and four Example XIX) developers are provided in Table 12. Both tables follow Example XIX.

EXAMPLE XIX

MAGENTA LIQUID DEVELOPERS CHARGED WITH BASIC BARIUM PETRONATE (BBp) CONTAINING SULFOLANE AND CYCLIC ALKYLENE CARBONATE ADDITIVES

A magenta liquid toner dispersion (developer) at 1 percent toner solids in NORPAR 15® was prepared as a 1,500 gram masterbatch described in Control 6. To each of four 200 gram developer portions of the above magenta masterbatch developer were added 1.2 grams of the same charge director (1.0 percent in NORPAR 15® prepared in Example XIII) used to bump-up the Control 6 developer. The Control 6 developer after 28 days ambient storage without additive at an initial charge director concentration (CD) of 30 milligrams of CD to 1 gram of toner solids or 3.0 percent CD per gram of toner solids was bumped-up in CD concentration to 36 milligrams of CD to 1 gram of toner solids or 3.6 percent CD per gram of toner solids. The Example XIX developers also contained an initial charge director (CD) concentration of 30 milligrams of CD to 1 gram of toner solids or 3.0 percent CD per gram of toner solids and after 25 days of ambient storage 0.25 weight percent (based on 200 gram weight of developer) of additive was added, and the developers were then allowed to equilibrate ambiently with the additive for 3 additional days prior to bumping-up the CD concentration to 36 milligrams of CD to 1 gram toner solids or 3.6 percent CD per gram of toner solids. Table 12 summarizes the formulations for the Example XIX developers and the Control 6 developer.

TABLE 12

Magenta Toner Formulations for Control 6 and Example XIX Developers

| Developer 1% in Toner Solids | Grams 1% Developer from Control 6 Masterbatch (mg CD/g Toner Solids-Initial) | Grams 1.0% CD from Ex. XIII CD for Bump-up (mg CD/g Toner Solids-Final | Grams and Kind of Additive [% Conc. in Developer] Additive Equilibrated in Developer |
|---|---|---|---|
| Control 6 | 200.00 (at 30/1) | 1.2 (36/1) | none |
| Example XIX-1 | 200.00 (at 30/1) | 1.2 (36/1) | 0.5 of sulfolane [0.25] |
| Example XIX-2 | 200.00 (at 30/1) | 1.2 (36/1) | 0.5 of ethylene carbonate [0.25] |
| Example XIX-3 | 200.00 (at 30/1) | 1.2 (36/1) | 0.5 of propylene carbonate [0.25] |

TABLE 12-continued

| Magenta Toner Formulations for Control 6 and Example XIX Developers | | | |
|---|---|---|---|
| Developer 1% in Toner Solids | Grams 1% Developer from Control 6 Masterbatch (mg CD/g Toner Solids-Initial) | Grams 1.0% CD from Ex. XIII CD for Bump-up (mg CD/g Toner Solids-Final | Grams and Kind of Additive [% Conc. in Developer] Additive Equilibrated in Developer |
| Example XIX-4 | 200.00 (at 30/1) | 1.2 (36/1) | 0.5 of butylene carbonate [0.25] |

Inspection of Table 13 indicates that in 1.0 hour or less the four Example XIX developers containing equilibrated additives for about 3 days all had a larger mobility value at the beginning of the ESA time-series measurement versus the Control 6 developer which contained no additive. Thus, the presence of additive effects an increase in mobility prior to the charge director (CD) bump-up in concentration. After the CD bump-up, the mobility increase was in most of the Example XIX developers still larger than that obtained in the Control 6 developer. All final mobilities for the Example XIX developers in 1 hour or less were considerably larger than the final mobility obtained for the Control 6 developer in 5 hours. Thus, the additives were beneficial in increasing the charging rate of the Example XIX developers.

TABLE 13

| Impact of Sulfolane and Cyclic Alkylene Carbonate Additives on Magenta Developers Containing BBP Charge Director | | | | |
|---|---|---|---|---|
| Developer: Age and Additve Status at Initial CD Conc. | Toner Conc. and Example No. | Additive Level and Mode of Addition to Developer and CD Example No. | ESA Time-Series Data: Mobilities in $m^2/Vs \times -1\ E^{-10}$ (Conductivities in pmho/cm) Change in CD Conc. in mg/g | Comments |
| Control 6 28 days at 30/1 CD w/o additive | Example IV Magenta | No additive throughout; $CD_{initial\ +\ added}$ Example XIII | 1.02(3)→→→→→0.90(12) time 0 5.0 hrs. 30/1 36/1 no additive→→→→→→ | Large mobility increase (+1.45) from low mobility value |
| Example XIX-1 25 days at 30/1 CD w/o additive & then 3 days with additive | Example IV Magenta | 0.25% sulfolane in developer for 3 days prior to CD bump-up $CD_{nitial\ \&\ added}$ Example XIII | 1.71(3)→→→→→→3.27(5) time 0 0.3 hr. 30/1 36/1 + additive→→→→→→→ | Larger mobility increase (+1.56) from additive equilibrated (1.71 vs. 1.02 for control) for control) |
| Example XIX-2 25 days at 30/1 CD w/o additive & then 3 days with additive | Example IV Magenta | 0.25% ethylene carbonate in developer for 3 days prior to CD bump-up $CD_{initial\ \&\ added}$ Example XIII | 1.25(2)→→→→→→2.87(5) time 0 1.0 hr 30/1 36/1 + additive→→→→→→→ | Larger mobility increase (+1.62) from additive equilibrated larger mobility (1.25 vs. 1.02 for control) |
| Example XIX-3 25 days at 30/1 CD w/o additive & then 3 days with additive | Example IV Magenta | 0.25% propylene carbonate in developer for 3 days prior to CD bump-up $CD_{initial\ \&\ added}$ Example XIII | 1.33(2)→→→→→→2.97(6) time 0 0.3 hr. 30/1 36/1 + additive→→→→→→→ | Larger mobility increase (+1.64) from additive equilibrated larger mobility (1.33 vs. 1.02 for control) |
| Example XIX-4 25 days at 30/1 CD w/o additive & then 3 days with additive | Example IV Magenta | 0.25% butylene carbonate in developer for 3 days prior to CD bump-up $CD_{initial\ \&\ added}$ Example XIII | 1.88(3)→→→→→→3.32(7) time 0 0.6 hr. 30/1 36/1 + additive→→→→→→→ | Sample mobility increase (+1.44) from additive equilibrated larger mobility (1.88 vs. 1.02 for control) |

| | | |
|---|---|---|
| 3-methylsulfolane | 30 to 43 | at 25° C. |
| butadiene sulfone | 30 to 43 | at 25° C. |
| N,N-dimethylformamide | 37 | at 25° C. |
| N,N-dimethylacetamide | 38 | at 25° C. |
| N-methylpyrrolidone | 32 | at 25° C. |
| tetramethylene sulfoxide | 43 | at 30° C. |
| tetramethylene sulfone | 43 | at 25° C. |
| propylene carbonate | 57 | at 40° C. |
| propylene carbonate | 65 | at 25° C. |
| ethylene carbonate | 90 | at 40° C. |
| ethylene carbonate | 95 | at 25° C. |

Other embodiments and modifications of the present invention may occur to those of ordinary skill in the art subsequent to a review of the present application and the information presented herein; these embodiments and modifications, as well as equivalents thereof, are also included within the scope of this invention.

What is claimed is:

1. A liquid developer comprised of thermoplastic resin particles, a charge director, a liquid component, an additive selected from the group consisting of cyclic carbonates, cyclic sulfones, cyclic sulfoxides, and organic amides; pigment, and a charge adjuvant.

2. A liquid developer in accordance with claim 1 wherein the charge director is a protonated AB diblock copolymer selected from the group consisting of poly[2-dimethylammoniumethyl methacrylate bromide co-2-ethylhexyl methacrylate], poly[2-dimethylammoniumethyl methacrylate tosylate co-2-ethylhexyl methacrylate], poly[2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide, and poly[2-dimethylammoniumethyl methacrylate tosylate co-N,N-dibutylacrylamide].

3. A liquid developer in accordance with claim 1, wherein the organic amide is selected from the group consisting of N,N-dimethylformamide, N,N-diethylformamide, N,N-dimethylacetamide, N,N-diethylacetamide, N,N-dimethylpropionamide, N,N-dimethylacrylamide, N,N-dimethylmethacrylamide, N,N,N',N'-tetramethylsuccinamide, N,N,N',N'-tetramethyladipamide, N-t-butylformamide, N,N-di-t-butylformamide, N-t-butylacetamide, N,N-di-t-butylacetamide, N,N,N'-trimethyl-N'-t-butylsuccinimide, N,N'-di-t-butyladipamide, N,N,N',N'-tetramethylurea, hexamethylphosphoramide, N-methyl-2-pyrrolidone, N-ethyl-2-pyrrolidone, 1,5-dimethyl-2-pyrrolidone, N-methyl-2-azetidinone, N-methyl-2-piperidone, N-methylcaprolactam, N-formyl-pyrrolidine, N-formyl-piperidine, 4-formyl-morpholine, N,N-dimethylcarboxamido-2-tetrahydrofuran, piperazine-N,N'-dicarboxaldehyde, N,N-dimethylbenzamide, N,N-dimethylbenzamide, and N,N,N',N'-tetramethylisophthalamide.

4. A liquid developer in accordance with claim 1 wherein the cyclic sulfones are tetramethylene sulfone, 3-methylsulfolane, 2,4-dimethylsulfolane, butadiene sulfone, trimethylene sulfone, pentamethylene sulfone, hexamethylenesulfone, 2,3-dimethylthiirene- 1,1-dioxide, or 2,3-diphenylthiirene-1,1-dioxide.

5. A liquid developer in accordance with claim 1 wherein the cyclic carbonates are ethylene carbonate or 1,3-dioxalane-3-one, vinylene carbonate, propylene carbonate or 4-methyl-1,3-dioxolan-2-one, butylene carbonate or 4,5-dimethyl-1,3-dioxolan-2-one, trimethylene carbonate, or tetramethylene carbonate.

6. A liquid developer in accordance with claim 1 wherein the cyclic sulfoxides are trimethylene sulfoxide, tetramethylene sulfoxide, pentamethylene sulfoxide, or hexamethylene sulfoxide.

7. A liquid electrostatographic developer comprised of (A) a liquid with a viscosity of from about 0.5 to about 20 centipoise and a resistivity greater than or equal to about $5\times10^9$; (B) pigment and thermoplastic resin particles, and wherein said resins possess an average volume particle diameter of from about 0.1 to about 30 microns and additives selected from the group consisting of cyclic sulfones, cyclic sulfoxides, cyclic carbonates, and organic amides; (C) charge director comprised of a protonated AB diblock copolymer of the formula

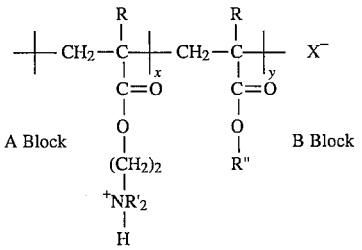

wherein $X^-$ is a conjugate base or anion of a strong acid; R is hydrogen or alkyl R' is alkyl R" is an alkyl group containing from about 6 to about 20 carbon atoms and y and x represent the number average degree of polymerization (DP) wherein the ratio of y to x is in the range of from about 10 to 2 to about 100 to 20; (D) charge adjuvant; and wherein the (B) and (D) components are dispersed in a mixture of (A) and (C).

8. A developer in accordance with claim 7 wherein the charge director is a protonated AB diblock copolymer selected from the group consisting of poly[2-dimethylammoniumethyl methacrylate bromide co-2-ethylhexyl methacrylate], poly[2-dimethylammoniumethyl methacrylate tosylate co-2-ethylhexyl methacrylate], poly[2-dimethylammoniumethyl methacrylate chloride co-2-ethythexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate], poly[2-dimethyammoniumethyl acrylate tosylate co-2-ethylhexyl acrylate], poly[2-dimethylammoniumethyl methacrylate chloride co-2-ethythexyl acrylate], poly[2-dimethylammoniumethyl acrylate chloride co-2-ethythexyl acrylate], poly [2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], poly[2-dimethylammoniumethyl methacrylate tosylate co-N,N-dibutylacrylamide], and mixtures thereof.

9. A developer in accordance with claim 7 wherein said resin particles are comprised of a copolymer of ethylene and an amide or ester of an α, β-ethylenically unsaturated acid selected from the group consisting of acrylic acid and methacrylic acid; and a copolymer of ethylene and methacrylic acid with a melt index at 190° C. of 500.

10. A developer in accordance with claim 1 wherein said resin is a copolymer of ethylene and an amide or ester of an α, β-ethylenically unsaturated acid selected from the group consisting of acrylic acid and methacrylic acid; and a copolymer of ethylene and methacrylic acid with a melt index at 190° C. of 500.

11. An electrostatic developer in accordance with claim 7 wherein the pigment is present in a amount of from about 1 to about 30 percent by weight based on the total weight of the developer solids of resin, pigment, additive, and charge adjuvant.

12. A developer in accordance with claim 7 wherein the charge director is present in an amount of from about 0.1 to about 10 weight percent based on the weight of the developer solids, and the additive with a dielectric constant of from about 30 to about 100 is present in an amount of from about 0.1 to about 0.3 weight percent; and there is enabled a negatively charged toner with electrosonic acoustic mobilities of about $2\times10^{-10}$ $m^2$/volts second.

13. A developer in accordance with claim 7 wherein component (A) is present in an amount of from about 85 percent to about 99.9 percent by weight, based on the total weight of the liquid developer, and the total weight of developer solids is from about 0.1 percent to about 15 percent by weight; component (C) is present in an amount of from about 0.25 to about 1,500 milligrams/gram developer solids; and component (D) is present in an amount of from about 0.1 to about 15 percent by weight based on the total weight of developer solids.

14. A developer in accordance with claim 7 wherein the charge adjuvant is a polyhydroxy compound which contains at least 2 hydroxy groups, an amino alcohol, polybutylene succinimide and the metallic soaps di-t-butyl aluminum salicylate, aluminum tristearate, aluminum distearate, barium, calcium, lead, and zinc stearates; cobalt, manganese, lead, and zinc lineolates, aluminum, calcium, and cobalt octoates; calcium and cobalt oleates; zinc palmitate; calcium, cobalt, manganese, lead, and zinc resinates, or AB diblock copolymers of 2-ethylhexylmethacrylate-co-methacrylic acid calcium and ammonium salts.

15. A developer in accordance with claim 1 wherein the liquid is an aliphatic hydrocarbon.

16. A developer in accordance with claim 15 wherein the aliphatic hydrocarbon is a mixture of branched hydrocarbons of from about 12 to about 20 carbons atoms.

17. A developer in accordance with claim 1 wherein the pigment is cyan, magenta, yellow, red, green, brown or mixtures thereof.

18. A developer in accordance with claim 1 wherein the pigment is carbon black, and the dielectric constant of said additive is from about 30 to about 100.

19. A developer in accordance with claim 1 wherein the additive is present in an amount of from about 0.05 to about 5 weight percent.

20. A developer in accordance with claim 1 wherein the additive is 3-methyl sulfolane, 2,4-dimethyl sulfolane, butadiene sulfone, tetramethyl sulfoxide, or dimethyl carbonate.

* * * * *